US011351081B1

(12) United States Patent
Azzam

(10) Patent No.: US 11,351,081 B1
(45) Date of Patent: Jun. 7, 2022

(54) BACK STRETCHER BED ASSEMBLY

(71) Applicant: Ali Azzam, Anchorage, AK (US)

(72) Inventor: Ali Azzam, Anchorage, AK (US)

( * ) Notice: Subject to any disclaimer, the term of this patent is extended or adjusted under 35 U.S.C. 154(b) by 489 days.

(21) Appl. No.: 16/414,145

(22) Filed: May 16, 2019

(51) Int. Cl.
*A61H 1/02* (2006.01)

(52) U.S. Cl.
CPC ..... *A61H 1/0222* (2013.01); *A61H 1/0292* (2013.01); *A61H 2201/1207* (2013.01)

(58) Field of Classification Search
CPC ..... A61H 1/0222; A61H 1/0292; A61H 2201/1207; A61H 1/00; A61H 1/02; A61H 1/0218; A61F 5/00; A61F 5/04; A61F 5/05; A61F 5/058; A61F 5/05883; A61G 13/00; A61G 13/0009; A61G 13/009; A61G 13/08; A61G 13/12; A61G 13/121; A61G 13/1245; A61G 13/1285; A61G 7/00; A61G 1/04; A47C 20/026; A47G 9/1009; A47G 9/1054
See application file for complete search history.

(56) References Cited

U.S. PATENT DOCUMENTS

| | | | | |
|---|---|---|---|---|
| 1,142,422 | A | 6/1915 | Hawley | |
| 1,915,841 | A | 6/1933 | Warner | |
| 2,693,796 | A | 11/1954 | Warner | |
| 4,356,816 | A | 11/1982 | Granberg | |
| 4,465,427 | A | 8/1984 | Granberg | |
| 6,049,926 | A * | 4/2000 | Amaral | A61G 13/12 5/622 |
| 7,089,613 | B2 * | 8/2006 | Cohen | A61G 13/12 5/640 |
| 2003/0093022 | A1 * | 5/2003 | Sund | A61F 5/04 602/33 |
| 2010/0160127 | A1 * | 6/2010 | Bracci | A61H 1/0292 482/143 |
| 2011/0218086 | A1 | 9/2011 | Boren | |
| 2019/0254911 | A1 * | 8/2019 | Brask | A61H 1/0229 |

FOREIGN PATENT DOCUMENTS

| | | | |
|---|---|---|---|
| EP | 0240229 | A2 | 7/1987 |

* cited by examiner

*Primary Examiner* — Justine R Yu
*Assistant Examiner* — Matthew R Moon
(74) *Attorney, Agent, or Firm* — Michael J. Tavella

(57) ABSTRACT

A back stretcher that has a basket shaped held support and an extending foot holder. In use, the patient is placed on the table. The patient' head is placed in the head support basket. The patient's feet are secured to the foot support. Once activated, the device slowly extends the foot support outwards, which causes the patient to be stretched. This system is safer than other systems because the patient's head, although supported, is not tied to the apparatus-especially under the chin or around the patient's neck. Unlike other tables, this table is one-piece making construction simpler and less costly. Finally, inasmuch as the foot portion is the only section that is moved, the mechanism is simpler and therefore more economical.

10 Claims, 6 Drawing Sheets

BACK STRETCHER BED ASSEMBLY

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to back stretchers and particularly to back stretchers with a solid bed portion.

2. Description of the Prior Art

People have suffered with bad backs for millennia. Over the centuries, many treatments have been devised to treat bad backs. One of these treatments involves stretching the back. There have been many devices to accomplish this. Examples of these can be found in the following U.S. Pat. No. 1,142,422, which teaches a bed for medical treatments that has vibration and a stretching mechanism that uses a head harness and a foot harness. These harnesses are connected to two rods that move in opposite directions. As an operator turns a wheel, the patient's head is pulled one way and the patient's feet the opposite way. In this way, stretching is achieved. U.S. Pat. No. 1,915,841 teaches a device in which a patient can be stretched by attaching the patient's feet to one rod and the patient's neck to a second rod. A rack and pinion system moves the rods in opposite directions, stretching the patient. U.S. Pat. No. 2,693,796 teaches a spinal traction machine which has a divided table. The lower portion has bindings to secure a patient's feet and the upper portion has bindings to secure the patient's torso. When operated, the bed portions are moved apart to effect stretching of the patient. U.S. Pat. No. 4,356,816 teaches a device that has a bed onto which the patient's hips are secured. The patient's upper body is secured separately. The patient's neck is also secured to an cable that passes through pulleys. In operation, the device pulls on the patient's neck and hips to effect stretching. U.S. Pat. No. 4,465,427; is a device that uses means to stretch a patient's hips or neck depending on what type of treatment is needed. US 2011/0218086A1 teaches a motorized bed that uses gravity to stretch a patient. Here. The patient's feet are placed in padded rollers. The bed is then tilted so that the patient's feet are elevated, causing the patient to be pulled downward by gravity to effect stretching. Finally, European Patent application EP0240229 A2 teaches a divided bed that can be used to stretch a patient similar to that shown in U.S. Pat. No. 2,693,796 discussed above. All of these devices are used to treat patients. Most involve attaching a cradle of some type to a patient's neck so that the upper body is stretched as well as the lower body. While this does help, it is also dangerous because patients may strangle in such devices. Some attach to the feet and others to the lower body. Most are large heavy-duty machines that are difficult to transport. Others are more compact and designed to be easily transportable. The transportable machines tend to be light weight with flimsy mechanisms that provide limited capability of providing good stretching.

BRIEF DESCRIPTION OF THE INVENTION

The instant invention overcomes the difficulties described above. It is a back stretcher that has a basket shaped held support and an extending foot holder. In use, the patient is placed on the table. The patient' head is placed in the head support basket. The patient's feet are secured to the foot support. Once activated, the device slowly extends the foot support outwards, which causes the patient to be stretched. This system is safer than other systems because the patient's head, although supported, is not tied to the apparatus-especially under the chin or around the patient's neck. Unlike other tables, this table is one-piece making construction simpler and less costly. Finally, inasmuch as the foot portion is the only section that is moved, the mechanism is simpler and therefore more economical.

DETAILED DESCRIPTION OF THE INVENTION

Figure 1:
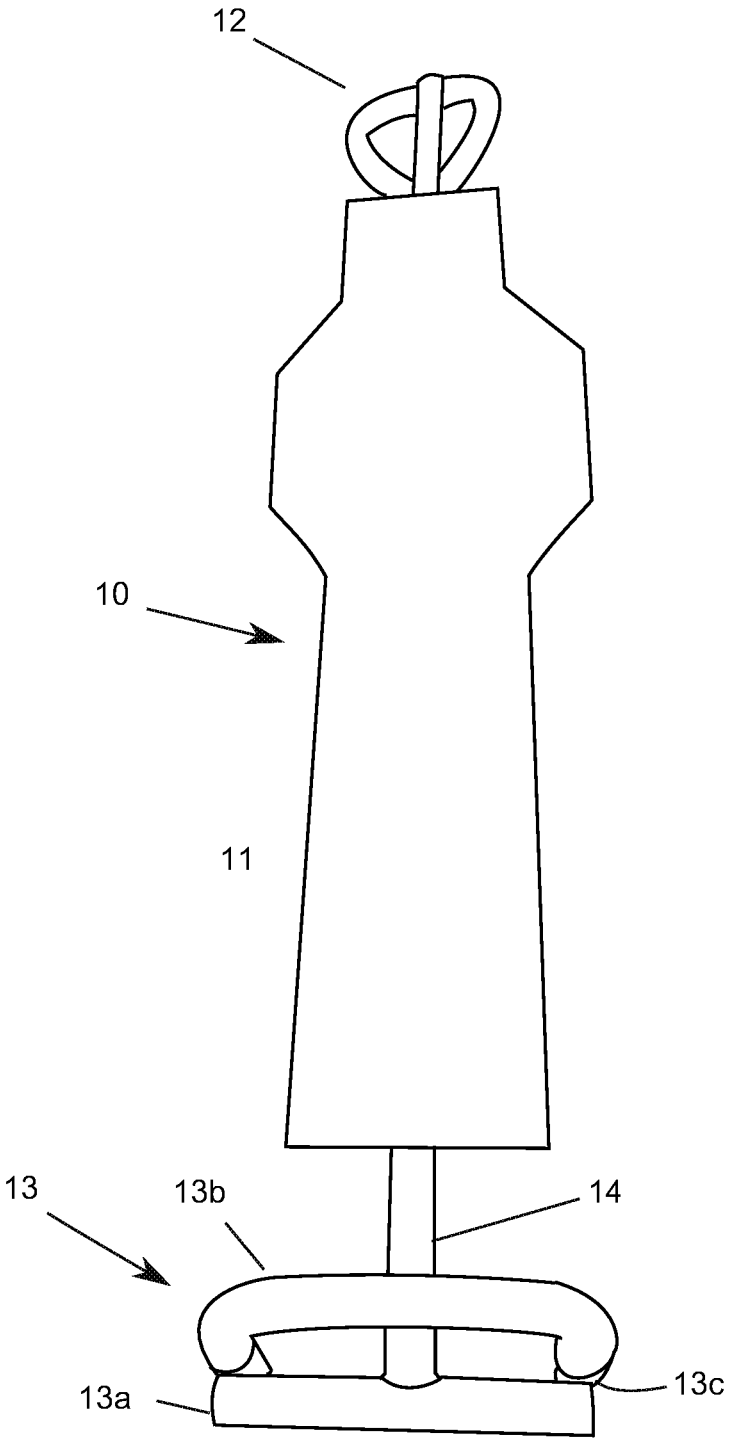
FIG. 1 is a top perspective view of the invention looking from the foot holder showing the foot holder extended.
Figure 2:
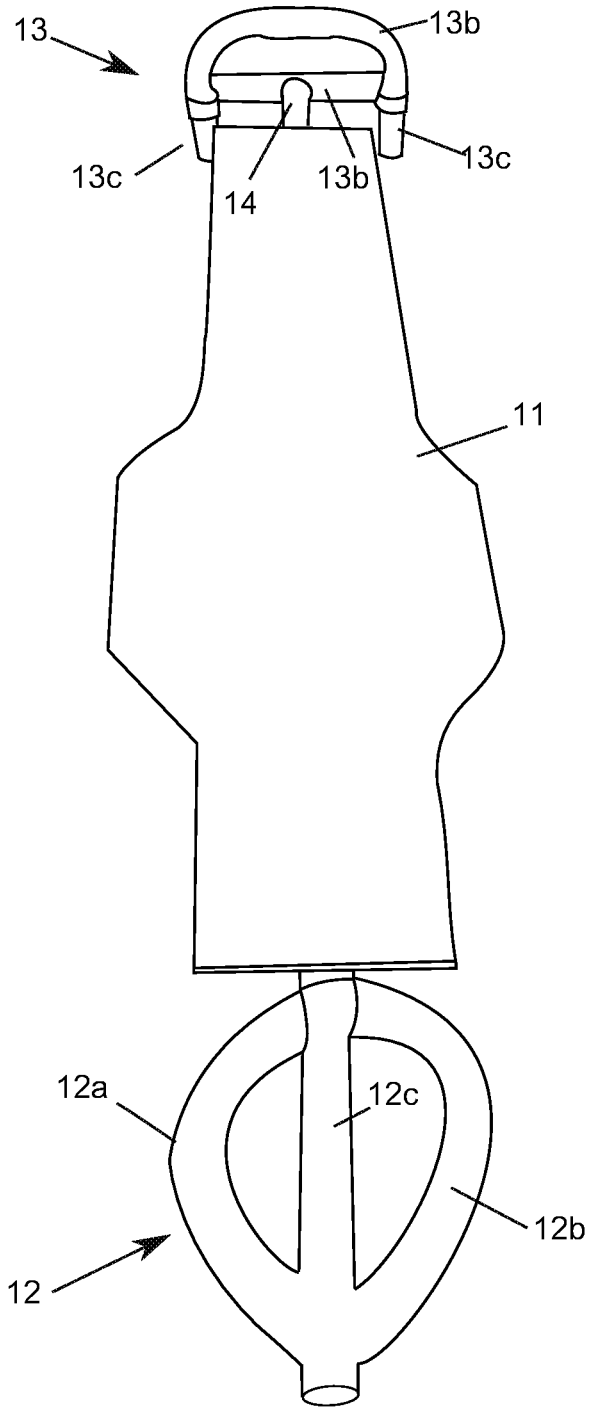
FIG. 2 is a top perspective view of the invention looking from the head portion.
Figure 3:
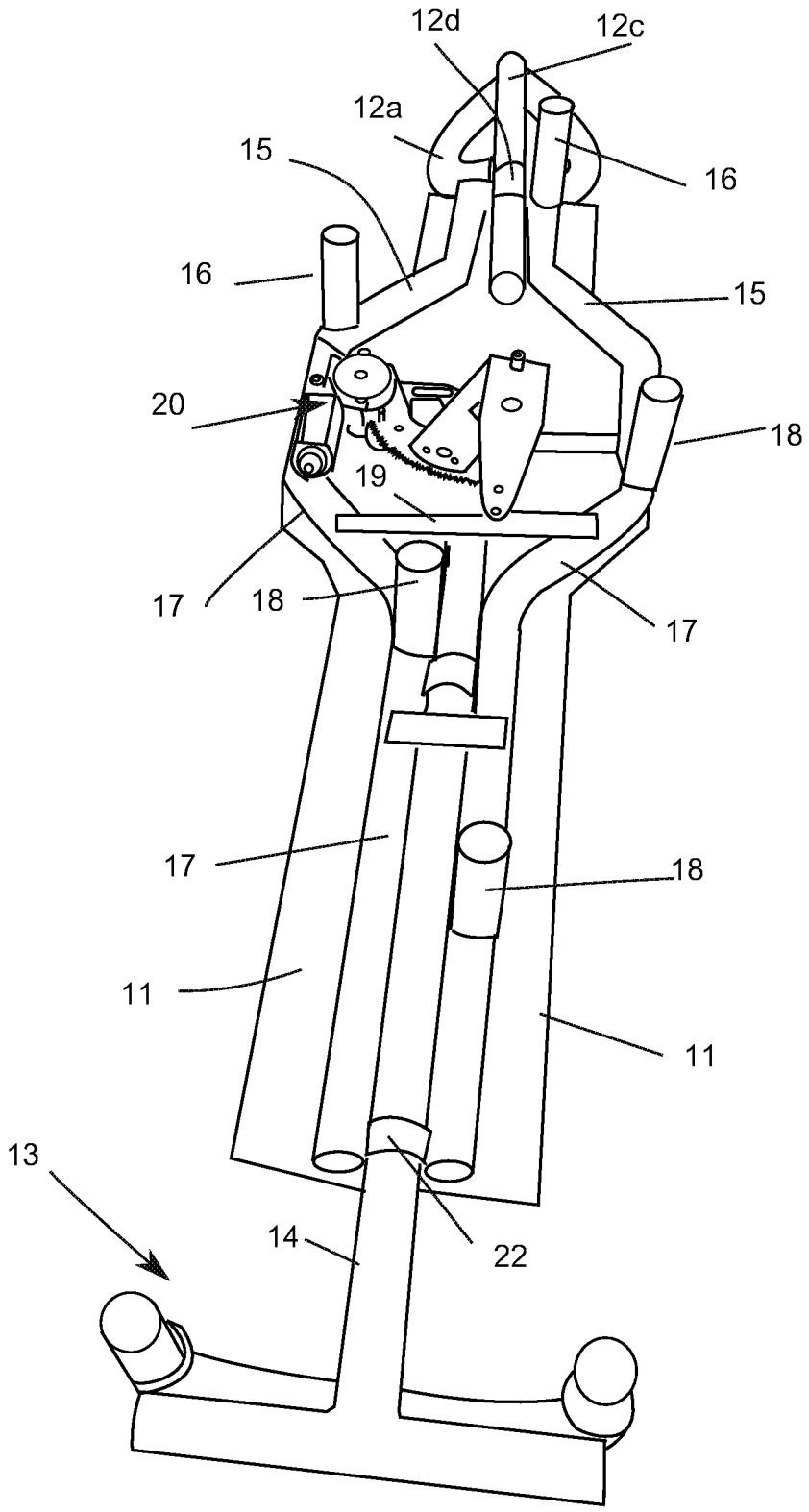
FIG. 3 is a bottom perspective view of the invention looking from the foot holder, showing the foot holder expanded.

Referring now to the drawings and especially FIGS. 1, 2, and 3, the device 10 is shown in a top view. Here, the bed portion 11 is shown. In it's basic form, the bed is a piece of plywood or similar material. It can be covered with padding and cushions as desired. At the top of the bed portion 11 is the head support 12, which is a frame made of tubing, see also FIG. 2. In the preferred embodiment, the head support is designed to support, not hold, a patient's head. At the other end of the bed 11 is the foot holder frame 13. The foot holder frame 13 is attached to the operating arm 14, which is attached to the drive system, discussed below. In this view, the foot holder frame is shown extended. The foot holder frame 13 consists of a frame That has a lower tubing member 13*a* that attaches to the operating arm 14, a curved upper portion 13*b*, through which a patient's feet are placed, and a pair of legs 13*c* (see FIG. 3). Note that additional legs are positioned about the frame, but are not visible in this view.

FIG. 2 is a top perspective view of the invention 10 looking from the head portion 12. In this view, the head portion 12 is shown in greater detail. The head portion 12 consists of a pair of curved tubes 12*a* and 12*b*, which are not only curved in the horizontal plane as shown, but are also curved slightly in the vertical plane (see, FIG. 5). In the center is a piece of tubing 12*c*. In use, the tubing 12*c* supports the user's head while the two curved pieces 12*a* and 12*b* provide side support. Of course, in use, the head support is covered with pads or cushions. The head portion 12 is also adjustable. The tube 12*c* can be extended or retracted as desired, to accommodate different patients. Note, in this view, the foot holder frame 13 is shown as well as the operating arm 14.

FIG. 3 is a bottom perspective view of the invention 10 looking from the foot holder frame 13 showing the foot holder frame 13 extended. Note that the underside of the invention 10 is shown. At the top is the head support 12. The tubing 12*c* is slidably secured to the bed 11 with a clamp 12*d*, which is also secured to the upper frame 15. In this figure, note that the center tube 12*c* can be adjusted by moving the tube inwardly or outwardly as desired. Note legs 16 are attached to the upper frame as shown. Note too that the upper frame 15 follows the contours of the bed 11 to ensure it is properly supported. In the center of the upper portion is the motor and gear system 20, discussed below.

A lower frame 17 extends downward below the motor and gear system 20 as shown. Note the legs 18 that are attached at various points on the lower frame 17.

The operating arm 14 is shown extended upwards and it connects to the motor and gear system 20 with a bracket 19. The operating arm 14 also is supported by a cross brace 21 and a through clamp 22. In this way, the operating arm 14 is free to slide under the bed portion, allowing the foot holder frame to move to stretch the patient. Note, again, that in this figure, the operating arm 14 is extended and the foot holder frame 13 is at it's full outward extension.

Figure 4:
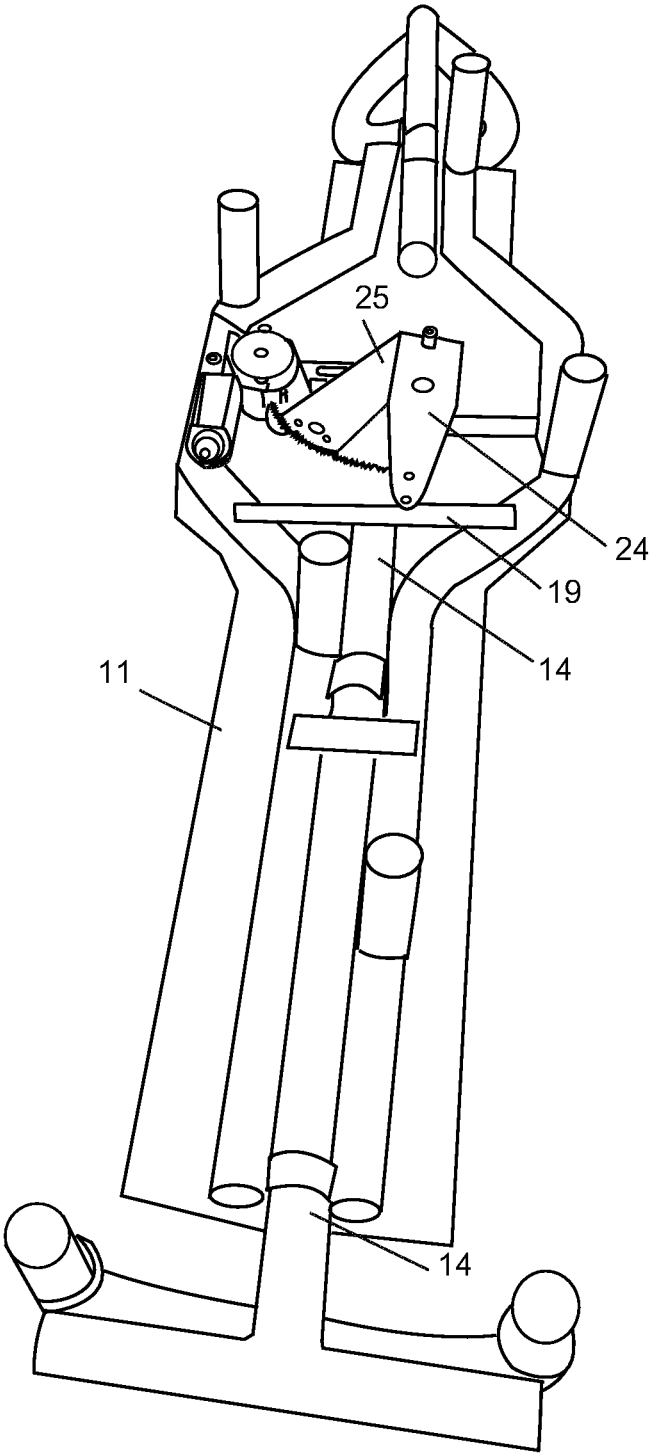
FIG. 4 is a bottom perspective view of the invention looking from the foot holder, showing the foot holder retracted.

FIG. 4 is a bottom perspective view of the invention looking from the foot holder, showing the foot holder retracted. In this figure, the operating arm 14 is shown pulled up into the device. This is caused by moving the gear system, as discussed below. The motor and gear system 20 is connected to the operating arm 14 by the bracket 19. As the motor and gear system operates, it moves the bracket 19 and the operating arm 14 in and out as discussed below.

Figure 5:
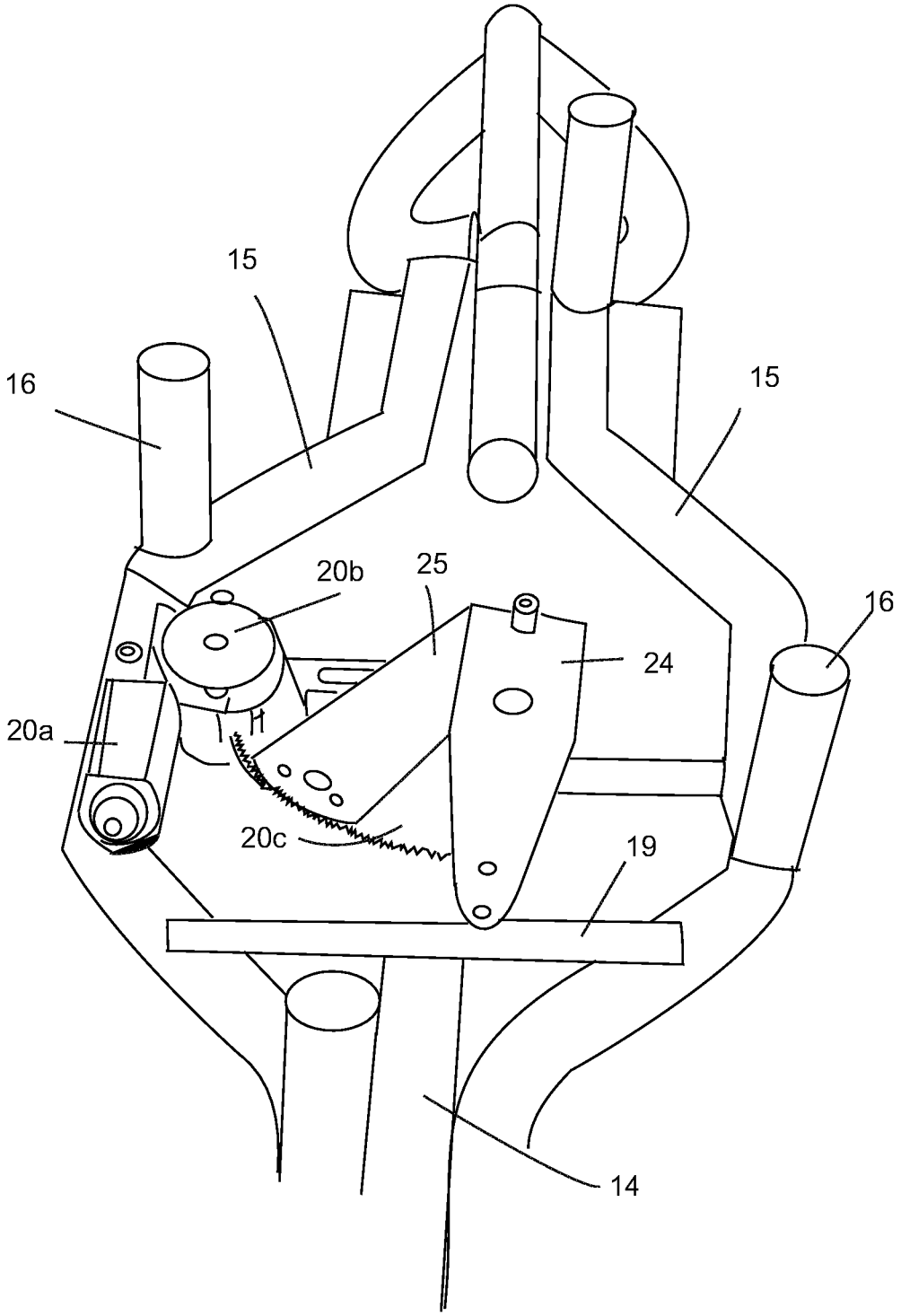
FIG. 5 is an enlarged view of the motor and gear system.

FIG. 5 is an enlarged view of the motor and gear system 20. As discussed above, the operating arm 14 is connected to bracket 19, which is in turn attached to the motor and gear system 20. The motor and gear system 20 consists of a motor 20*a* that has a shaft (not shown) that connects to a gearbox 20*b*. The gearbox 20*b* has a gear (not shown) that attaches to the drive gear 20*c*. The drive gear 20*c* has a plate 20*d* that rides on the drive gear. The plate 20*d* is attached to an arm 20*e* by a pivot pin 20*f* at one end. The arm 20*e* is then attached to the bracket 19 by another pin 20*g*. As the device operates, the motor turns the gear box, which in turn pushes or pulls the drive gear back and forth as shown by the arrows. This in turn moves the plate 20*e*, which in turn causes the arm 20*e* to push or pull the bracket 19, and in turn, the operating arm 14.

Figure 6:
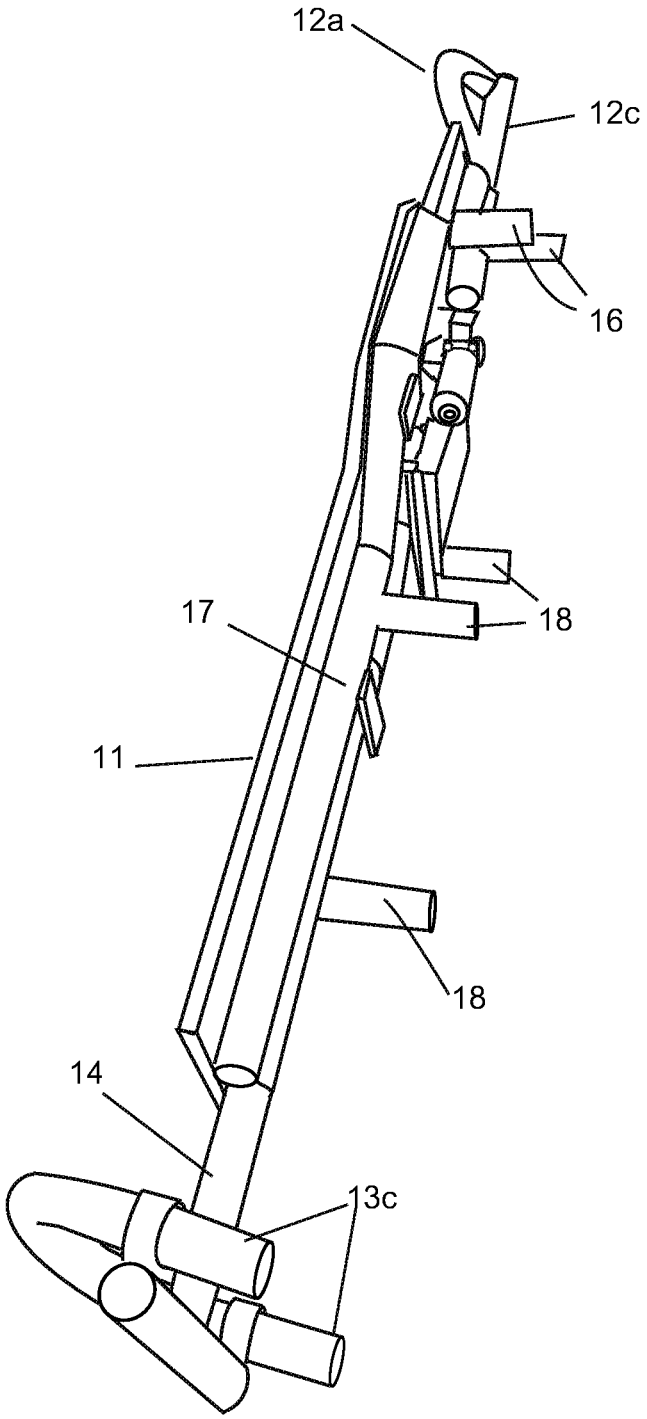
FIG. 6 is a side detail view of the invention.

FIG. 6 is a side detail view of the invention. First, this view shows the various legs 13*c*, 16, and 18. These legs are shown as short stubs. Their length, however can be adjusted as desired. For example, legs can be telescoping so that the device can be transported easier. Longer leg portions can also be permanently added to make the bed any desired height. Legs can be telescoping to allow the height of the bed to be changed as desired.

Second, as noted above, the head portion 12 is shown from the side. Here, the curved tube 12*a* is shown. Note how the tube curves upwards. With both tubes 12*a* and 12*b* curved upwards, the tubes form a cradle for the patient's head.

In use, the patient is positioned on the bed such that the patient's head is placed in the cradle of the head portion 12, as discussed above. The patient's feet are secured in the foot holder frame 13, with the operating arm 14 fully retracted. The motor is then started and the gear system pushes the operating arm outward, thereby forcing the patient's feet and body to be stretched. Once the desired amount of stretch is achieved, the patient can repose for a time in that position before the motor and gears retract the operating arm so that the patient can be safely released from the machine.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A back stretcher bed assembly comprising:

a) a bed portion having a top end and a bottom end, an upper side and an underside;

b) a head support having a center tube with two sides, a distal end, a proximate end, and a middle portion, and two curved tubes each having a first end and a second end, one of said two curved tubes being secured to one side of said center tube such that the first end of said one of two curved tubes is attached to the distal end of said center tube and that the second end of said one of two curved tubes is attached to the middle portion of said center tube, and the other of said two curved tubes being secured to the other side of said center tube such that the first end of the other of two curved tubes is attached to the distal end of said center tube and that the second end of said other of two curved tubes is attached to the middle portion of said center tube, and further such that each of said two curved tubes is curved in a horizontal plane as well as a vertical plane, said head support being slidably attached to the underside of said bed portion;

c) a motor and drive gear system, attached to said underside of said bed portion;

d) a frame, attached to the underside of said bed portion;

e) an operating arm having a proximate end and a distal end, slidably attached to the underside of said bed portion, wherein said proximate end of said operating arm being in operable communication with said motor and drive gear system; and f) a foot holder frame, attached to the distal end of said operating arm.

2. The back stretcher bed assembly of claim 1 wherein said operating arm has a first position and a second position.

3. The back stretcher bed assembly of claim 2 wherein the first position of said operating arm is a fully retracted position and the second position of said operating arm is a fully extended position.

4. The back stretcher bed assembly of claim 1 wherein said motor and drive gear system comprises:

a) a motor;

b) a gearbox, attached to said motor;

c) a drive gear installed horizontally on the underside of said bed portion, in operable communication with said gearbox; and d) a plate, rotatably installed on the underside of said bed portion, having a first end attached to said drive gear and a second end attached to said proximate end of said operating arm.

5. The back stretcher bed assembly of claim 1 wherein the foot holder frame has a horizontal lower portion and a curved upper portion, forming a space therebetween.

6. The back stretcher bed assembly of claim 5 wherein the space between said horizontal lower portion and a curved upper portion of said foot holder frame is sized to accommodate a patient's feet.

7. The back stretcher bed assembly of claim 1 wherein the frame attached to the underside of said bed portion has a plurality of legs attached thereto.

8. The back stretcher bed assembly of claim 1 wherein the head support is adjustable.

9. The back stretcher bed assembly of claim 1 wherein the proximate end of said central tube is slidably attached to the underside of said bed portion.

10. The back stretcher bed assembly of claim 1 wherein the proximate end of said central tube is slidably attached to the frame attached to said bed portion.

* * * * *